US009360808B2

(12) United States Patent
Nagata

(10) Patent No.: US 9,360,808 B2
(45) Date of Patent: Jun. 7, 2016

(54) FIXING DEVICE WITH ANTISTATIC AGENT AND IMAGE FORMING APPARATUS

(71) Applicant: FUJI XEROX CO., LTD., Tokyo (JP)

(72) Inventor: Yasushi Nagata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/339,571

(22) Filed: Jul. 24, 2014

(65) Prior Publication Data

US 2015/0268598 A1 Sep. 24, 2015

(30) Foreign Application Priority Data

Mar. 24, 2014 (JP) ..... 2014-060628

(51) Int. Cl.
*G03G 15/20* (2006.01)

(52) U.S. Cl.
CPC ..... *G03G 15/2025* (2013.01)

(58) Field of Classification Search
CPC ..... G03G 15/2025; G03G 15/2057
USPC ..... 399/327
See application file for complete search history.

(56) References Cited

U.S. PATENT DOCUMENTS 5,534,985 A * 7/1996 Rosso et al. ..... 399/327
2006/0083560 A1* 4/2006 Fukuda ..... 399/327
2007/0053729 A1* 3/2007 Yamada et al. ..... 399/327
2009/0123200 A1* 5/2009 Achten et al. ..... G03G 15/2025 399/327
2012/0243924 A1* 9/2012 Moorlag et al. ..... 399/333
2014/0356018 A1* 12/2014 Nakamura et al. ..... 399/99

FOREIGN PATENT DOCUMENTS

JP 2005-221882 A 8/2005
JP 2013-235133 A 11/2013

* cited by examiner

*Primary Examiner* — Benjamin Schmitt
*Assistant Examiner* — Matthew Miller
(74) *Attorney, Agent, or Firm* — Sughrue Mion, PLLC

(57) ABSTRACT

A fixing device includes a fixing member having a medium heating member and rotating while nipping a medium to fix an unfixed image onto a surface thereof; a pressing member disposed facing the fixing member and applying pressure to the medium in a fixing region between the pressing and heating members; a cleaning member; and an antistatic member. The cleaning member is disposed downstream of the fixing region in a rotational direction of the pressing member and comes into contact therewith in a cleaning region extending in a direction orthogonal to a medium transport direction to clean the pressing member. The antistatic member is disposed downstream of the cleaning member and comes into contact with a surface of the pressing member in an antistatic region, which overlaps the cleaning region in the direction orthogonal to the medium transport direction, so as to eliminate static electricity from the pressing member.

8 Claims, 5 Drawing Sheets

FIXING DEVICE WITH ANTISTATIC AGENT AND IMAGE FORMING APPARATUS

CROSS-REFERENCE TO RELATED APPLICATIONS

This application is based on and claims priority under 35 USC 119 from Japanese Patent Application No. 2014-060628 filed Mar. 24, 2014.

BACKGROUND

Technical Field

The present invention relates to fixing devices and image forming apparatuses.

SUMMARY

According to an aspect of the invention, there is provided a fixing device including a fixing member, a pressing member, a cleaning member, and an antistatic member. The fixing member has a heating member that heats a medium and rotates while nipping the medium so as to fix an unfixed image onto a surface of the medium. The pressing member is disposed facing the fixing member and applies pressure to the medium in a fixing region between the pressing member and the heating member. The cleaning member is disposed downstream of the fixing region in a rotational direction of the pressing member and comes into contact with the pressing member in a cleaning region extending in a direction orthogonal to a medium transport direction so as to clean the pressing member. The antistatic member is disposed downstream of the cleaning member in the rotational direction of the pressing member and comes into contact with a surface of the pressing member in an antistatic region, which overlaps the cleaning region in the direction orthogonal to the medium transport direction, so as to eliminate static electricity from the pressing member.

BRIEF DESCRIPTION OF THE DRAWINGS

Exemplary embodiments of the present invention will be described in detail based on the following figures, wherein.

DETAILED DESCRIPTION

Figure 1:
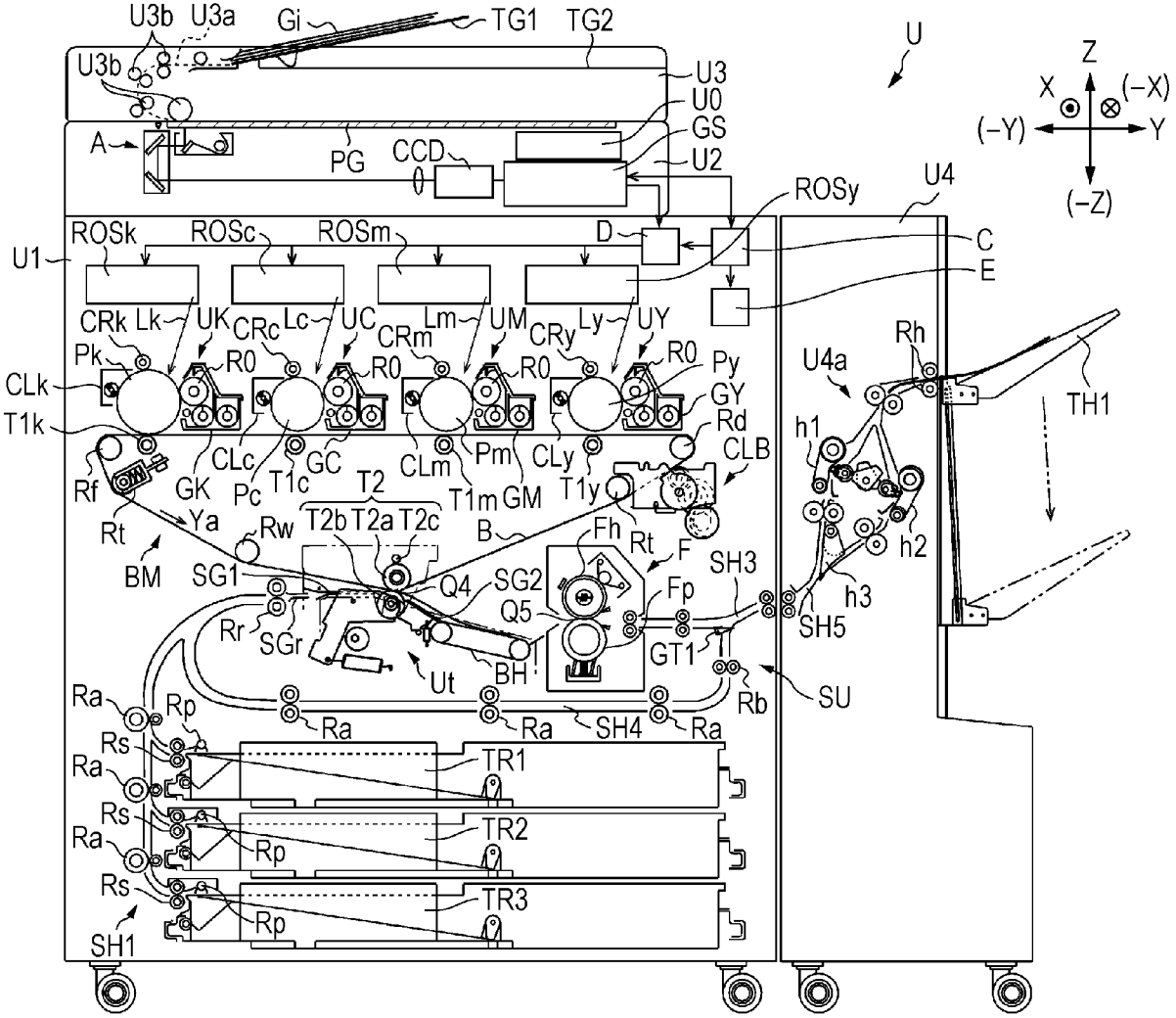
FIG. 1 illustrates an image forming apparatus according to a first exemplary embodiment.

Although specific exemplary embodiments (referred to as "exemplary embodiments" hereinafter) of the present invention will be described below with reference to the drawings, the present invention is not to be limited to the following exemplary embodiments.

In order to provide an easier understanding of the following description, the front-rear direction will be defined as "X-axis direction" in the drawings, the left-right direction will be defined as "Y-axis direction", and the up-down direction will be defined as "Z-axis direction". Moreover, the directions or the sides indicated by arrows X, −X, Y, −Y, Z, and −Z are defined as forward, rearward, rightward, leftward, upward, and downward directions, respectively, or as front, rear, right, left, upper, and lower sides, respectively.

Furthermore, in each of the drawings, a circle with a dot in the center indicates an arrow extending from the far side toward the near side of the plane of the drawing, and a circle with an "x" therein indicates an arrow extending from the near side toward the far side of the plane of the drawing.

In the drawings used for explaining the following description, components other than those for providing an easier understanding of the description are omitted where appropriate.

First Exemplary Embodiment

FIG. 1 illustrates an image forming apparatus according to a first exemplary embodiment.

In FIG. 1, a copier U as an example of the image forming apparatus according to the first exemplary embodiment has a printer section U1 as an example of an image-forming-apparatus body as well as an example of an image recording device. A scanner section U2 as an example of a reader as well as an example of an image reading device is supported above the printer section U1. An auto-feeder U3 as an example of a document transport device is supported above the scanner section U2. The scanner section U2 according to the first exemplary embodiment supports a user interface U0 as an example of an input section. An operator may perform input operation on the user interface U0 so as to operate the copier U.

A post-processing device U4 is disposed to the right of the printer section U1.

A document tray TG1 as an example of a medium container is disposed at an upper part of the auto-feeder U3. The document tray TG1 is capable of accommodating a stack of multiple documents Gi to be copied. A document output tray TG2 as an example of a document output section is formed below the document tray TG1. Document transport rollers U3*b* are arranged along a document transport path U3*a* between the document tray TG1 and the document output tray TG2.

A platen glass PG as an example of a transparent document table is disposed at the upper surface of the scanner section U2. In the scanner section U2 according to the first exemplary embodiment, a read optical system A is disposed below the platen glass PG. The read optical system A according to the first exemplary embodiment is supported in a movable manner in the left-right direction along the lower surface of the platen glass PG. Normally, the read optical system A is stationary at an initial position shown in FIG. 1.

An imaging element CCD as an example of an imaging member is disposed to the right of the read optical system A. The imaging element CCD is electrically connected to an image processor GS.

The image processor GS is electrically connected to a controller C and a write circuit D in the printer section U1. The write circuit D is electrically connected to yellow (Y), magenta (M), cyan (C), and black (K) exposure devices ROSy, ROSm, ROSc, and ROSk.

In FIG. 1, photoconductor drums Py, Pm, Pc, and Pk as an example of image bearing members are disposed below the exposure devices ROSy, ROSm, ROSc, and ROSk, respectively.

In the rotational direction of the black (K) photoconductor drum Pk, the photoconductor drum Pk is surrounded by a charging unit CRk, a developing device GK, a first-transfer roller T1*k* as an example of a first-transfer unit, and a drum cleaner CLk as an example of an image-bearing-member cleaning unit.

The charging unit CRk receives, from a power supply circuit E, charge voltage for electrostatically charging the photoconductor drum Pk. The developing device GK has a developing roller R0 as an example of a developer bearing member. The developing roller R0 receives development voltage from the power supply circuit E. The first-transfer roller T1*k* receives, from the power supply circuit E, first-transfer voltage having reversed polarity relative to the charge polarity of the developer.

In the first exemplary embodiment, the photoconductor drum Pk, the charging unit CRk, and the drum cleaner CLk are combined as an image bearing unit UK. The image bearing unit UK is detachably supported by the printer section U1.

With regard to the Y, M, and C colors, image bearing units UY, UM, and UC having the same configuration as the black image bearing unit UK are provided. Therefore, the image bearing units UY, UM, and UC also have photoconductor drums Py, Pm, and Pc, charging units CRy, CRm, and CRc, and drum cleaners CLy, CLm, and CLc, respectively.

Furthermore, in the first exemplary embodiment, each of the developing devices GY to GK is also provided as a single unit and is detachably supported by the printer section U1.

The image bearing units UY, UM, UC, and UK and the developing devices GY, GM, GC, and GK constitute toner-image forming members UY+GY, UM+GM, UC+GC, and UK+GK, respectively.

A belt module BM as an example of an intermediate transfer device is disposed below the image bearing units UY to UK. The belt module BM includes an intermediate transfer belt B as an example of an intermediate transfer member, belt support rollers Rd, Rt, Rw, Rf, and T2*a* as an example of intermediate-transfer-member support members, and first-transfer rollers T1*y*, T1*m*, T1*c*, and T1*k*. The belt support rollers Rd, Rt, Rw, Rf, and T2*a* include a belt drive roller Rd as an example of a drive member, a tension roller Rt as an example of a tension applying member, a working roller Rw as an example of a meander prevention member, multiple idler rollers Rf as an example of driven members, and a backup roller T2*a* as an example of a second-transfer opposing member.

The intermediate transfer belt B is supported by the belt support rollers Rd, Rt, Rw, Rf, and T2*a* in a rotationally-movable manner in a direction indicated by an arrow Ya.

A second-transfer unit Ut is disposed below the backup roller T2*a*. The second-transfer unit Ut includes a second-transfer roller T2*b* as an example of a second-transfer member. The second-transfer roller T2*b* is supported such that it is movable into and out of contact with the backup roller T2*a* with the intermediate transfer belt B interposed therebetween. A second-transfer region Q4 as an example of an image recording region is formed by a region where the second-transfer roller T2*b* comes into contact with the intermediate transfer belt B. Furthermore, the backup roller T2*a* is in contact with a contact roller T2*c* as an example of a voltage-applying contact member. The contact roller T2*c* receives, from the power supply circuit E at a predetermined timing, second-transfer voltage having the same polarity as the charge polarity of the toners. The aforementioned rollers T2*a* to T2*c* constitute a second-transfer device T2.

A belt cleaner CLB as an example of an intermediate-transfer-member cleaning unit is disposed downstream of the second-transfer region Q4 in the rotational direction of the intermediate transfer belt B.

The first-transfer rollers T1*y* to T1*k*, the intermediate transfer belt B, the second-transfer device T2, the belt cleaner CLB, and so on constitute a transfer device T1+B+T2+CLB that transfers images on the surfaces of the photoconductor drums Py to Pk onto a sheet S.

Feed trays TR1 to TR3 as an example of medium accommodation sections are supported in an insertable-ejectable manner at a lower part of the printer section U1. The feed trays TR1 to TR3 accommodate sheets S as an example of media.

A pickup roller Rp as an example of a medium fetching member is disposed at the upper left side of each of the feed trays TR1 to TR3. A separating roller Rs as an example of a separating member is disposed to the left of the pickup roller Rp.

A medium transport path SH1 that extends upward is formed to the left of the feed trays TR1 to TR3. Multiple transport rollers Ra as an example of medium transport members are arranged along the transport path SH1.

In the transport path SH1, a registration roller Rr as an example of a delivering member is disposed in a downstream area in a transport direction of a sheet S as well as upstream of the second-transfer region Q4.

A registration guide SGr and a pre-transfer sheet guide SG1 as an example of medium guide members are arranged in this order at the downstream side of the registration roller Rr in the transport direction of a sheet S.

A post-transfer sheet guide SG2 as an example of a medium guide member is disposed downstream of the second-transfer region Q4 in the transport direction of a sheet S. A transport belt BH as an example of a medium transport member is disposed downstream of the post-transfer sheet guide SG2 in the transport direction of a sheet S.

A fixing device F is disposed downstream of the transport belt BH in the transport direction of a sheet S. The fixing device F includes a heating roller Fh as an example of a heating fixation member and a pressing roller Fp as an example of a pressing fixation member. A fixing region Q5 is formed by a region where the heating roller Fh and the pressing roller Fp come into contact with each other.

An output path SH3 as an example of a medium transport path is formed downstream of the fixing device F in the transport direction of a sheet S. The output path SH3 extends rightward toward the post-processing device U4.

A downstream end of the output path SH3 is connected to an upstream end of an inversion path SH4 as an example of a medium transport path. The inversion path SH4 according to the first exemplary embodiment extends below the second-transfer unit Ut and above the uppermost feed tray TR1 so as to merge with the transport path SH1 at the upstream side of the registration roller Rr. A first gate GT1 as an example of a transport-path switch member is disposed at a position where the inversion path SH4 branches off from the output path SH3.

A processing path SH5 as an example of a medium transport path is formed in the post-processing device U4. A decurler U4*a* as an example of a bending correcting device is disposed in the processing path SH5. The decurler U4*a* according to the first exemplary embodiment includes a first curl correcting member h1 and a second curl correcting member h2 as an example of bending correcting members.

An output roller Rh as an example of an output member is disposed downstream of the decurler U4*a* in the transport direction of a sheet S. An output tray TH1 as an example of an output section is disposed downstream of the output roller Rh in the transport direction of a sheet S. The output tray TH1 according to the first exemplary embodiment is supported in a movable manner in the up-down direction in accordance with the number of loaded sheets S.

The components given the reference characters SH1 to SH5 described above constitute a medium transport path SH according to the first exemplary embodiment. Furthermore, the components given the reference characters SH, Ra, Rr, Rh, SGr, SG1, SG2, BH, GT1, and so on constitute a medium transport system SU.

Description of Image Forming Operation

Referring to FIG. 1, in the copier U according to the first exemplary embodiment, when a copy start button is input in the user interface U0, the scanner section U2 reads a document.

If copying is to be performed by automatically transporting documents by using the auto-feeder U3, the read optical system A stays stationary at the initial position and exposes documents Gi sequentially passing through a read position on the platen glass PG to light. Thus, the multiple documents Gi accommodated in the document tray TG1 sequentially pass through the document read position on the platen glass PG and are then output onto the document output tray TG2.

If copying is to be performed by allowing an operator to manually place a document Gi on the platen glass PG, the read optical system A moves in the left-right direction so as to scan the document on the platen glass PG while exposing the document to light.

Reflected light from the document Gi is focused onto the imaging element CCD via the read optical system A. The imaging element CCD converts the reflected light of the document focused on an imaging surface into an electric signal.

The image processor GS converts the read signal input from the imaging element CCD into a digital image signal and outputs the signal to the write circuit D in the printer section U1. At a predetermined timing, the write circuit D outputs laser drive signals corresponding to yellow (Y), magenta (M), cyan (C), and black (K) image information input from the image processor GS to the exposure devices ROSy, ROSm, ROSc, and ROSk as an example of write devices.

The controller C outputs signals for controlling, for example, the timing at which the write circuit D outputs the signals as well as for controlling the power supply circuit E.

The surfaces of the photoconductor drums Py to Pk are electrostatically charged by the charging units CRy to CRk, respectively. With regard to the photoconductor drums Py to Pk with the electrostatically-charged surfaces, electrostatic latent images are formed thereon by laser beams Ly, Lm, Lc, and Lk as an example of write light beams output from the exposure devices ROSy, ROSm, ROSc, and ROSk. The electrostatic latent images on the surfaces of the photoconductor drums Py to Pk are developed into toner images as an example of yellow (Y), magenta (M), cyan (C), and black (K) visible images by the developing devices GY to GK.

The toner images on the surfaces of the photoconductor drums Py to Pk are transferred onto the intermediate transfer belt B by the first-transfer rollers T1*y* to T1*k*. If a multicolor image, that is, a color image, is to be formed, the toner images on the photoconductor drums Py to Pk are sequentially superimposed and transferred onto the intermediate transfer belt B. In the case of black image data only, only the black (K) photoconductor drum Pk and developing device GK are used so that only a black toner image is formed. Therefore, only a black toner image is transferred onto the intermediate transfer belt B.

After the first-transfer process, the toners remaining on the surfaces of the photoconductor drums Py to Pk are cleaned by the drum cleaners CLy to CLk.

The toner images transferred on the intermediate transfer belt B are transported to the second-transfer region Q4.

A sheet S from one of the trays TR1 to TR3 is fetched by the pickup roller Rp at a predetermined feed timing. If multiple stacked sheets S are fetched by the pickup roller Rp, the sheets S are separated from each other one-by-one by the separating roller Rs. The sheet S having passed through the separating roller Rs is transported to the registration roller Rr by the multiple transport rollers Ra.

The registration roller Rr delivers the sheet S in accordance with the timing at which the toner images are transported to the second-transfer region Q4. The sheet S delivered by the registration roller Rr is guided by the guides SGr and SG1 so as to be transported to the second-transfer region Q4.

The toner images on the intermediate transfer belt B are transferred onto the sheet S by the second-transfer device T2 as the toner images pass through the second-transfer region Q4. In the case of a color image, the toner images superimposed and first-transferred on the surface of the intermediate transfer belt B are collectively second-transferred onto the sheet S.

With regard to the intermediate transfer belt B having passed through the second-transfer region Q4, the toners remaining thereon are cleaned by the belt cleaner CLB.

The sheet S having the toner images second-transferred thereon is transported to the fixing device F via the post-transfer sheet guide SG2 and the transport belt BH as an example of a pre-fixation medium transport member. The toner images on the surface of the sheet S are heated and fixed thereon by the fixing device F as the toner images pass through the fixing region Q5. The sheet S having the toner images heated and fixed thereon in the fixing region Q5 is transported along the output path SH3.

If the sheet S is to be output onto the output tray TH1, the sheet S transported along the output path SH3 is transported to the processing path SH5 in the post-processing device U4. A switch gate h3 switches the transport destination between the first curl correcting member h1 and the second curl correcting member h2 in accordance with a bent direction, that is, curled direction, of the sheet S transported to the processing path SH5. The curl correcting members h1 and h2 correct a curl of the sheet S passing therethrough. The curl-corrected sheet S is output onto the output tray TH1 by the output roller Rh.

If duplex printing is to be performed on the sheet S, the first gate GT1 switches the transport destination for the sheet S to the inversion path SH4 after the trailing edge of the sheet S passes through the first gate GT1. Then, the transport roller Ra at the downstream end of the output path SH3 and the transport roller Ra in the processing path SH5 rotate in the reverse direction. Thus, the sheet S having passed through the first gate GT1 is transported to the inversion path SH4 by the transport rollers Ra in a state where the transport direction is reversed. In other words, the sheet S is switched back. The switched-back sheet S is transported along the inversion path SH4 and is transported to the registration roller Rr in a state where the front and rear faces of the sheet S are inverted.

Description of Fixing Device According to First Exemplary Embodiment

Figure 2:
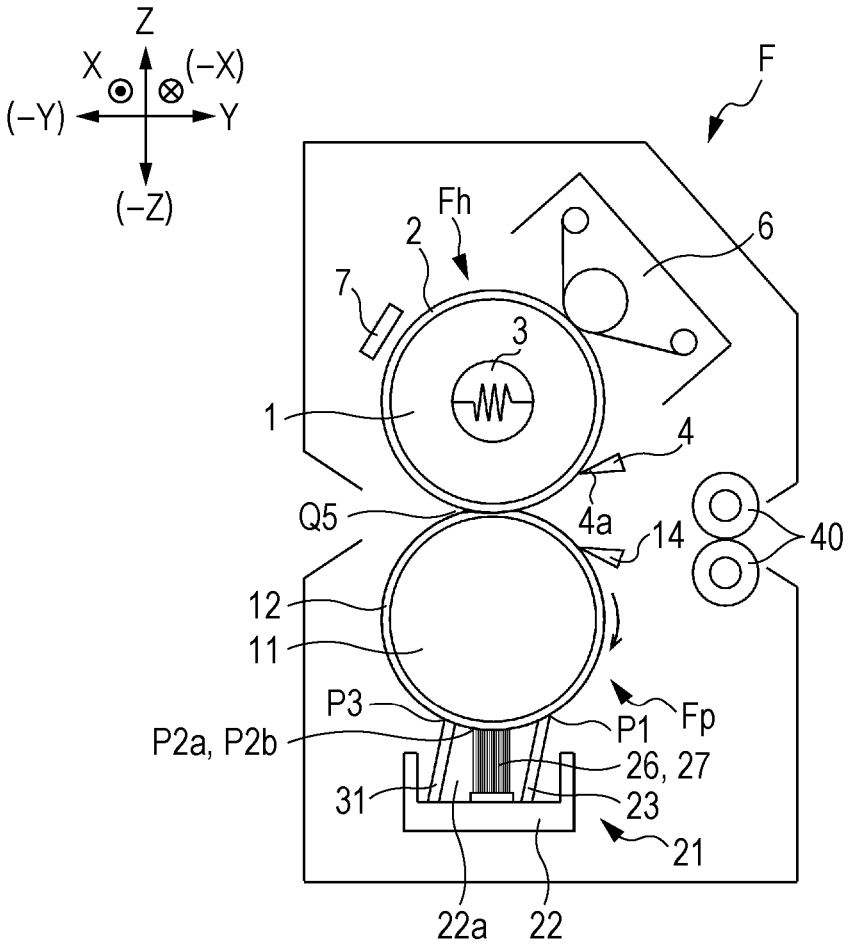
FIG. 2 is an enlarged view illustrating a relevant part of a fixing device according to the first exemplary embodiment.

FIG. 2 is an enlarged view illustrating a relevant part of the fixing device F according to the first exemplary embodiment.

Referring to FIGS. 1 and 2, in the fixing device F according to the first exemplary embodiment, the heating roller Fh as an example of a heating member has a heating-roller body 1 as an example of a cylindrical member. The heating-roller body 1 has a shape of a cylinder extending in the front-rear direction. The surface of the heating-roller body 1 is coated with a coating layer 2 as an example of a heating-member surface. The coating layer 2 according to the first exemplary embodiment is composed of a fluoroplastic material having high releasability. As an example of a fluoroplastic material, perfluoroalkoxy (PFA) is used for the coating layer 2 according to the first exemplary embodiment. The fluoroplastic material used is not limited to PFA and may alternatively be, for example, polytetrafluoroethylene (PTFE) or polyfluoroethylenepropylene (FEP: 4 ethylene fluoride-6 propylene fluoride).

The heating roller Fh has a built-in heater 3 as an example of a heat source. The heating roller Fh receives a driving force from a driving source (not shown). A peeling claw 4 as an example of a medium peeling member is disposed downstream of the fixing region Q5 in the rotational direction of the heating roller Fh. The peeling claw 4 according to the first exemplary embodiment has a shape of a wedge whose distal end 4*a* extends toward the surface of the heating roller Fh. In the first exemplary embodiment, multiple peeling claws 4 are arranged and spaced apart from each other in the axial direction of the heating roller Fh. A cleaning web 6 as an example of a cleaning member is disposed downstream of the peeling claws 4 in the rotational direction of the heating roller Fh. Furthermore, a temperature sensor 7 as an example of a temperature detecting member is disposed downstream of the cleaning web 6 in the rotational direction of the heating roller Fh.

Figure 3A:
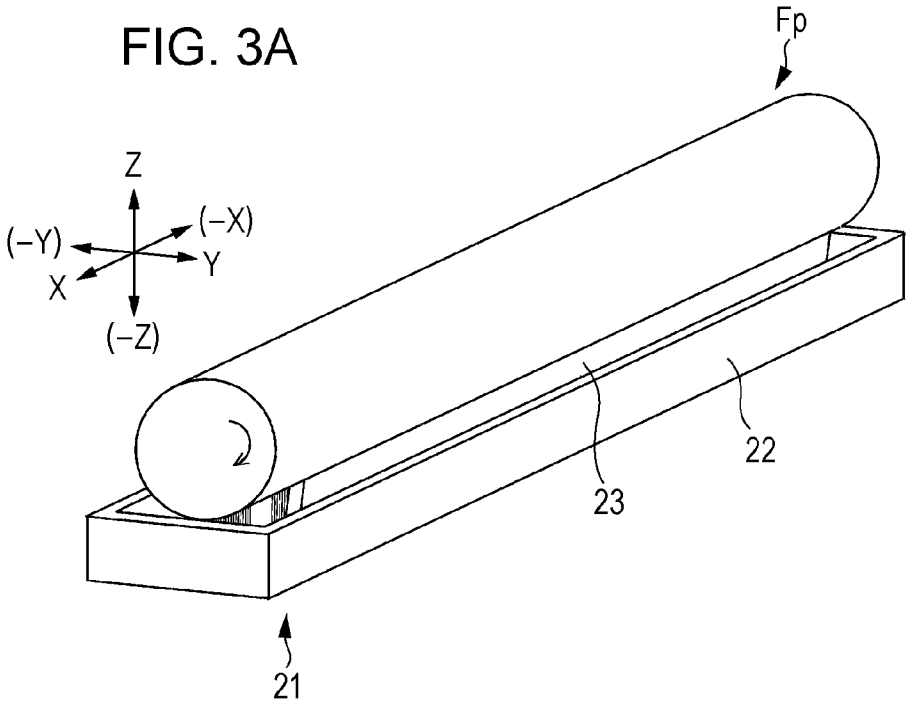
FIGS. 3A and 3B are enlarged views each illustrating a relevant part of a pressing member according to the first exemplary embodiment, FIG. 3A being a perspective view of the pressing member and FIG. 3B being a perspective view of a cleaning unit.
Figure 3B:
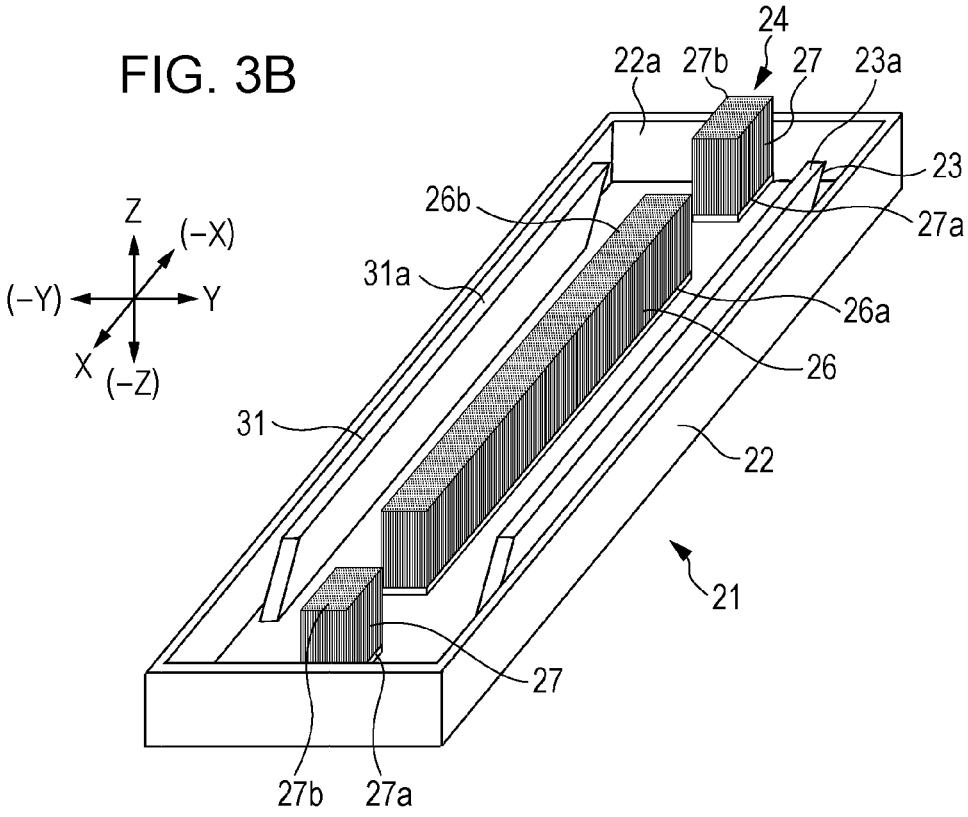

FIGS. 3A and 3B are enlarged views each illustrating a relevant part of the pressing roller Fp according to the first exemplary embodiment. Specifically, FIG. 3A is a perspective view of the pressing roller Fp, and FIG. 3B is a perspective view of a cleaning unit.

Referring to FIGS. 1 to 3B, the pressing roller Fp as an example of a pressing member has a pressing-roller body 11 as an example of a cylindrical member. The pressing-roller body 11 has a shape of a cylinder extending in the front-rear direction. The surface of the pressing-roller body 11 supports an electrically-conductive tube 12 as an example of a pressing-roller surface. The electrically-conductive tube 12 according to the first exemplary embodiment has a shape of a cylinder extending in the front-rear direction along the pressing-roller body 11. Furthermore, the electrically-conductive tube 12 according to the first exemplary embodiment is composed of an electrically-conductive material that is higher on the electrostatic series than the fluoroplastic material used for forming the coating layer 2 of the heating roller Fh. In the first exemplary embodiment, a rubber material obtained by adding carbon black as a conducting agent to silicone rubber is used. The rubber material used for the electrically-conductive tube 12 according to the first exemplary embodiment is not limited to silicone rubber and may alternatively be, for example, styrene-butadiene rubber (SBR). Furthermore, the conducting agent in the electrically-conductive tube 12 according to the first exemplary embodiment is not limited to carbon black and may alternatively be, for example, metal, such as graphite, aluminum, copper, or tin, or fine particles of a $SnO_2$—$In_2O_3$ solid solution.

The pressing roller Fp is pressed against the heating roller Fh by a spring as an example of a bias member (not shown). Thus, the pressing roller Fp is driven by rotation of the heating roller Fh. In the first exemplary embodiment, the heating roller Fh, the pressing roller Fp, and so on constitute a fixing member Fh+Fp.

A peeling claw 14 as an example of a medium peeling member is disposed downstream of the fixing region Q5 in the rotational direction of the pressing roller Fp. The peeling claw 14 according to the first exemplary embodiment has a configuration similar to that of each peeling claw 4.

A cleaner 21 as an example of a cleaning unit is disposed downstream of the peeling claw 14 in the rotational direction of the pressing roller Fp.

Description of Cleaning Unit

Figure 4:
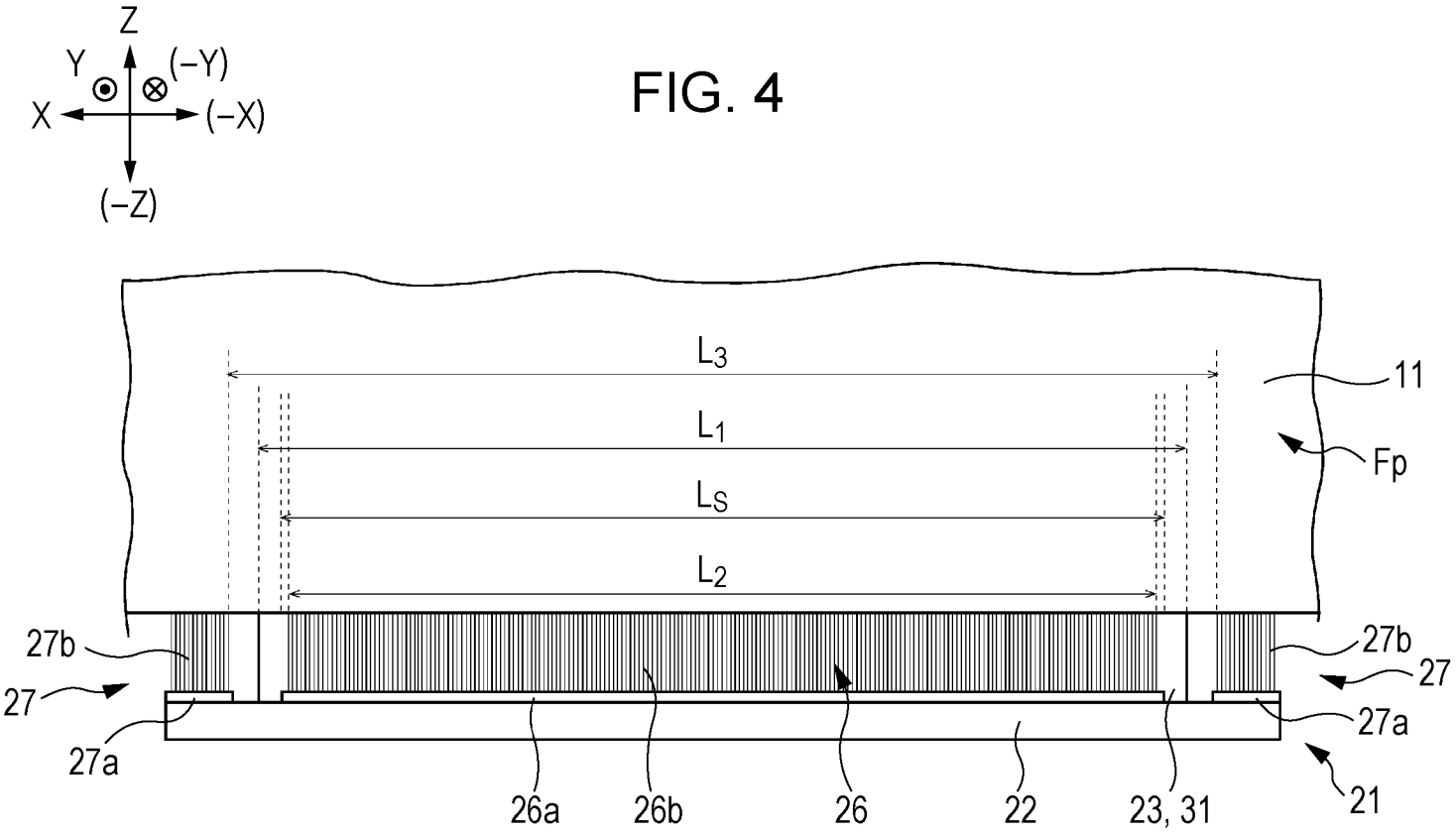
FIG. 4 is an enlarged view illustrating a relevant part of the cleaning unit according to the first exemplary embodiment.

FIG. 4 is an enlarged view illustrating a relevant part of the cleaning unit according to the first exemplary embodiment.

Referring to FIGS. 2 to 4, the cleaner 21 has a casing 22 as an example of a supporter. The casing 22 according to the first exemplary embodiment extends in the front-rear direction along the axis of the pressing roller Fp. An accommodation space 22*a* is formed within the casing 22. The accommodation space 22*a* extends in the front-rear direction along the casing 22. The casing 22 according to the first exemplary embodiment is detachably supported by the fixing device F. Furthermore, the casing 22 according to the first exemplary embodiment is composed of an electrically-conductive material. The casing 22 according to the first exemplary embodiment is connected to ground.

Moreover, an upstream end of the casing 22 in the rotational direction of the pressing roller Fp supports a cleaning blade 23 as an example of a cleaning member.

The cleaning blade 23 according to the first exemplary embodiment has a shape of a plate extending in the front-rear direction along the axis of the pressing roller Fp. The cleaning blade 23 according to the first exemplary embodiment comes into contact with the surface of the pressing roller Fp from a direction in which a distal end 23*a* faces upstream in the rotational direction of the pressing roller Fp, that is, from the counter direction. In this case, a contact region where the distal end 23*a* and the surface of the pressing roller Fp come into contact with each other forms a cleaning region P1.

Furthermore, in the first exemplary embodiment, opposite ends of the cleaning blade 23 in the front-rear direction are disposed within opposite ends of a width $L_S$ of a maximum-size sheet S usable in the copier U.

In FIGS. 3A and 3B, the casing 22 supports a static eliminator 24 at a position downstream of the cleaning blade 23 in the rotational direction of the pressing roller Fp.

The static eliminator 24 includes a first brush 26 as an example of an antistatic member and a pair of second brushes 27 as an example of second antistatic members disposed respectively at the opposite sides of the first brush 26 in the front-rear direction.

The brushes 26 and 27 have base fabric 26*a* and base fabric 27*a*, respectively. The base fabric 26*a* and the base fabric 27*a* extend in the axial direction of the pressing roller Fp.

Figure 5:
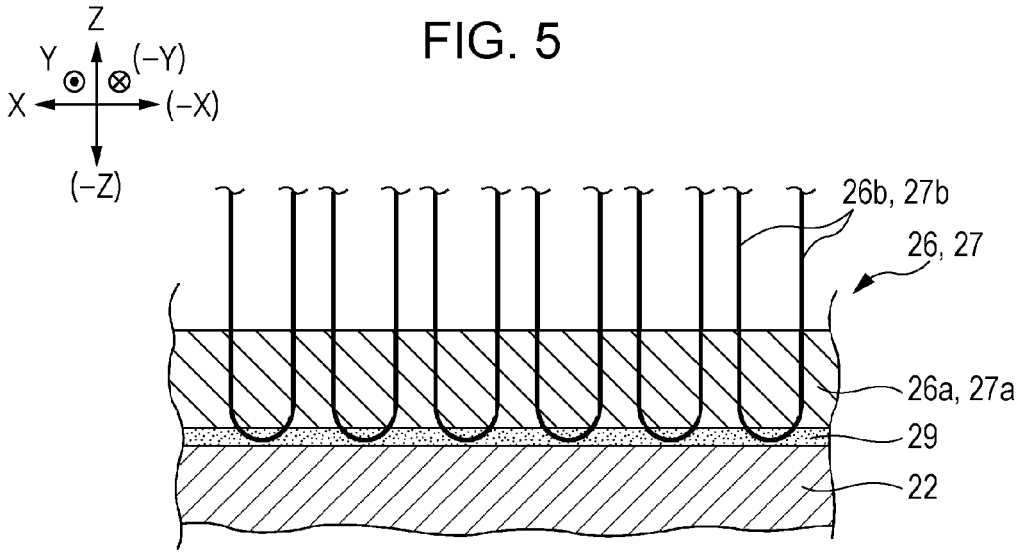
FIG. 5 is an enlarged view illustrating a relevant part of a static eliminator according to the first exemplary embodiment.

FIG. 5 is an enlarged view illustrating a relevant part of the static eliminator 24 according to the first exemplary embodiment.

In FIG. 5, the base fabric 26*a* and the base fabric 27*a* respectively have brush bristles 26*b* and brush bristles 27*b* as an example of contact sections. The brush bristles 26*b* and 27*b* according to the first exemplary embodiment have tip ends that come into contact with the surface of the pressing roller Fp. The brush bristles 26*b* and 27*b* according to the first exemplary embodiment are formed of electrically-conductive fibers. As shown in FIG. 5, the base ends of the brush bristles 26*b* and 27*b* are implanted into the base fabric 26*a* and the base fabric 27*a* such that the base ends are exposed from the undersurface of the base fabric 26*a* and the base fabric 27*a*. Furthermore, in the first exemplary embodiment, the lower surface of each of the base fabric 26*a* and the base fabric 27*a* is supported by the casing 22 via an electrically-conductive adhesive 29. Thus, the brush bristles 26*b* and 27*b* are connected to ground via the electrically-conductive adhesive 29 and the casing 22.

Therefore, a first antistatic region P2*a* as an example of an antistatic region is formed by a contact region where the brush bristles 26*b* of the first brush 26 and the surface of the pressing roller Fp come into contact with each other. In the first exemplary embodiment, a width $L_2$ of the first antistatic region P2*a* in the front-rear direction is set to be smaller than a width $L_1$ of the cleaning region P1 in the front-rear direction.

The brush bristles 27*b* of the second brushes 27 come into contact with the pressing roller Fp outside the front and rear ends of the cleaning region P1. Thus, a width $L_3$ between a pair of second antistatic regions P2*b* where the brush bristles 27*b* and the surface of the pressing roller Fp come into contact with each other is set to be larger than the width $L_S$ of a sheet S. Specifically, in the first exemplary embodiment, the widths are set so that the condition $L_3>L_s>L_1>L_2$ is satisfied.

Furthermore, the casing 22 supports a second cleaning blade 31 as an example of a second cleaning member at a position downstream of the static eliminator 24 in the rotational direction of the pressing roller Fp. The second cleaning blade 31 according to the first exemplary embodiment has the same configuration as the cleaning blade 23 described above. Similar to the distal end 23*a*, a second cleaning region P3 is formed by a contact region where a distal end 31*a* of the second cleaning blade 31 and the surface of the pressing roller Fp come into contact with each other. The width of the second cleaning region P3 is set to be the same as the width $L_1$ of the cleaning region P1 in the front-rear direction.

In the fixing device F according to the first exemplary embodiment, an output roller 40 as an example of an output member is disposed at a position downstream of the fixing region Q5 in the medium transport direction.

Operation of Fixing Device

In the copier U according to the first exemplary embodiment having the above-described configuration, a sheet S is transported to the fixing device F in a state where a toner with negative polarity transferred onto the sheet S at the second-transfer region Q4 is unfixed. When the sheet S is transported from the second-transfer region Q4 to the fixing region Q5, a portion of the unfixed toner transferred on the sheet S may sometimes float due to, for example, vibration during the transporting process.

If the floating toner adheres onto the surface of the heating roller Fh at the upstream side of the fixing region Q5, when the heating roller Fh rotates and passes through the fixing region Q5, the toner adhered to the heating roller Fh may become fixed onto the sheet S passing through the fixing region Q5, possibly deteriorating the image quality.

A fluoroplastic material having high releasability has been conventionally used for the coating layer 2 of the heating roller Fh for the purpose of reducing adhesion of the fixed toner onto the surface thereof. A fluoroplastic material is lower on the electrostatic series than the electrically-conductive tube 12 of the pressing roller Fp or the sheet S. Therefore, when the fixing member Fh+Fp rotates, the coating layer 2 tends to become electrostatically charged to negative polarity as the coating layer 2 comes into and out of contact with the electrically-conductive tube 12, the sheet S, and the cleaning web 6.

On the other hand, in the pressing roller Fp facing the heating roller Fh, the electrically-conductive tube 12 is connected to ground. Thus, an electric field that reduces adhesion of the negative-polarity toner onto the coating layer 2 is generated between the coating layer 2 of the heating roller Fh and the electrically-conductive tube 12 of the pressing roller Fp.

As discussed in an example of the related art, paper particles may adhere onto the pressing roller Fp or the toner at the back face of the sheet S may adhere onto the pressing roller Fp when duplex printing is performed. Thus, assuming that an antistatic brush is set in a sheet passing region of the sheet S, extraneous matter may accumulate in the antistatic brush. When such extraneous matter accumulates, the antistatic brush becomes contaminated, resulting in lower antistatic performance. Moreover, a block of the accumulated extraneous matter may become transferred back to the pressing roller Fp, possibly contaminating the back face of the sheet S.

Thus, in the related art, the antistatic brush is brought into contact outside the sheet passing region. However, the configuration that performs static elimination only outside the sheet passing region possibly results in insufficient static elimination.

In contrast, in the first exemplary embodiment, the first brush 26 is disposed downstream of the cleaning blade 23. Thus, the first brush 26 eliminates static electricity from the pressing roller Fp in a state where paper particles and the like have been removed by the cleaning blade 23 at the upstream side of the first brush 26.

Accordingly, accumulation of extraneous matter in the first brush 26 may be reduced, and insufficient static elimination may be prevented.

Furthermore, in the first exemplary embodiment, the second cleaning blade 31 is disposed downstream of the first brush 26. Thus, even when extraneous matter not sufficiently removed by the cleaning blade 23 accumulates in the first brush 26 and a block of the accumulated extraneous matter becomes transferred back to the pressing roller Fp, the accumulated extraneous matter is removed by the second cleaning blade 31. Therefore, contamination of the back face of the sheet S caused when the extraneous matter retransferred to the pressing roller Fp adheres onto the sheet S passing through the fixing region Q5 may be reduced.

Furthermore, the second cleaning blade 31 according to the first exemplary embodiment may prevent toner floating at the upstream side of the fixing region Q5 or paper particles from entering the cleaner 21. Thus, adhesion and accumulation of toner and the like floating in the first brush 26 may be prevented.

Furthermore, in the first exemplary embodiment, the cleaning blades 23 and 31 and the first brush 26 have different widths in the front-rear direction. Thus, the cleaning blades 23 and 31 and the first brush 26 are disposed such that the front and rear ends thereof are not aligned. Therefore, with regard to the electrically-conductive tube 12 according to the first exemplary embodiment, the position thereof that comes into contact with the front and rear ends of the cleaning blades 23 and 31 and the position thereof that comes into contact with the front and rear ends of the first brush 26 are offset from each other in the front-rear direction.

Furthermore, in the first exemplary embodiment, the cleaning blades 23 and 31 that remove extraneous matter from the electrically-conductive tube 12 are each pressed against the electrically-conductive tube 12 with a predetermined force. The first brush 26 is also pressed against the electrically-conductive tube 12 so that the first brush 26 is reliably brought into contact with the electrically-conductive tube 12.

Thus, in the electrically-conductive tube 12, a change in shape occurs at a boundary between a portion thereof against which the cleaning blades 23 and 31 and the first brush 26 are pressed and a portion thereof against which the cleaning blades 23 and 31 and the first brush 26 are not pressed. This causes stress to concentrate easily at the boundary position, that is, at an edge position of the cleaning blade 23 and so on.

In a provisional configuration in which the front and rear ends of a cleaning blade and the front and rear ends of an antistatic brush are positionally aligned, stress concentration of the cleaning blade and stress concentration of the antistatic brush would be applied to the same position of the electrically-conductive tube 12 in the front-rear direction. Thus, with this configuration, the same location of the electrically-conductive tube 12 is subjected to abrasion by repeatedly receiving a large force. In the worst case, the electrically-conductive tube 12 may possibly break.

In contrast, with the configuration according to the first exemplary embodiment, the front and rear ends of the cleaning blades 23 and 31 are not positionally aligned with the front and rear ends of the first brush 26. This reduces repeated reception of a large force by the same location of the electrically-conductive tube 12, thereby reducing abrasion. Therefore, as compared with the configuration in which the front and rear ends of a cleaning blade and the front and rear ends of an antistatic brush are positionally aligned, damages to the electrically-conductive tube 12 may be reduced in the configuration according to the first exemplary embodiment, thereby achieving a longer lifespan of the electrically-conductive tube 12.

Furthermore, in the first exemplary embodiment, the second brushes 27 are disposed outside the front and rear ends of the cleaning region P1. Thus, in addition to the first brush 26, the second brushes 27 also eliminate static electricity from the pressing roller Fp. Therefore, the performance for eliminating static electricity from the pressing roller Fp may be improved with the configuration according to the first exemplary embodiment, as compared with a configuration in which static electricity is eliminated from the pressing roller Fp by using the first brush 26 alone. Thus, static electricity may be more reliably eliminated from the pressing roller Fp.

Furthermore, in the first exemplary embodiment, the cleaner 21 is detachably supported by the fixing device F, and the cleaner 21 supports the brushes 26 and 27. In the related art, antistatic brushes at the front and rear ends are not replaced since they are supported by a member such as a frame that is not replaced until the lifespan of the copier U is reached. This possibly results in deterioration of the antistatic performance of the antistatic brushes over time.

In contrast, with the configuration according to the first exemplary embodiment, the cleaning blades 23 and 31, which are components to be periodically replaced due to degradation as a result of contact with the pressing roller Fp, as well as the brushes 26 and 27 are replaceable. Therefore, the performance for eliminating static electricity from the pressing roller Fp may be maintained.

Second Exemplary Embodiment

Next, a second exemplary embodiment of the present invention will be described. In the description of the second exemplary embodiment, components that correspond to those in the first exemplary embodiment are given the same reference characters, and detailed descriptions thereof are omitted.

Although the second exemplary embodiment differs from the first exemplary embodiment in terms of the following point, other points are similar to those in the first exemplary embodiment.

Description of Fixing Device According to Second Exemplary Embodiment

Figure 6:
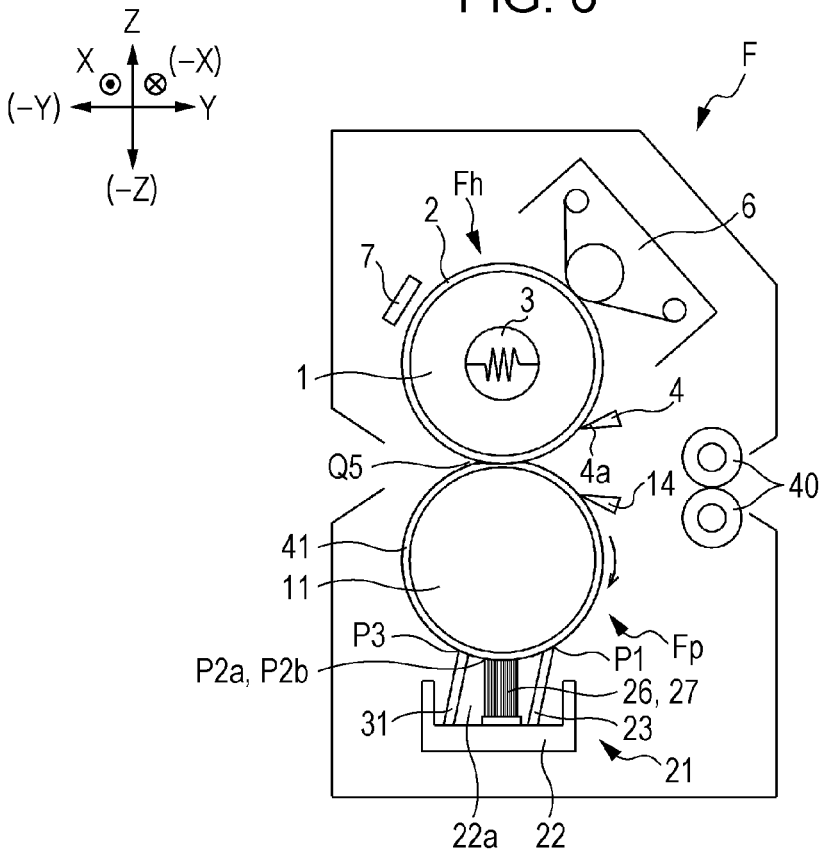
FIG. 6 is an enlarged view illustrating a relevant part of a fixing device according to a second exemplary embodiment and corresponds to FIG. 2 in the first exemplary embodiment.

FIG. 6 is an enlarged view illustrating a relevant part of a fixing device F according to the second exemplary embodiment and corresponds to FIG. 2 in the first exemplary embodiment.

Referring to FIG. 6, in the fixing device F according to the second exemplary embodiment, the surface of the pressing-roller body 11 is coated with a coating layer 41 as an example of a surface layer. The coating layer 41 according to the second exemplary embodiment is similar to the coating layer 2 in being composed of a fluoroplastic material as an example of a highly-releasable material that is lower on the electrostatic series than the sheet S. Although PFA as an example of a fluoroplastic material is used for the coating layer 41 according to the second exemplary embodiment, for example, PTFE, FEP, or the like may be used as an alternative.

Operation of Second Exemplary Embodiment

In the second exemplary embodiment, the coating layer 41 of the pressing roller Fp is similar to the coating layer 2 of the heating roller Fh in being composed of a fluoroplastic material. The coating layer 41 is lower on the electrostatic series than the sheet S. Thus, when the fixing member Fh+Fp transports the sheet S downstream in the medium transport direction, the coating layer 2 and the coating layer 41 tend to become electrostatically charged to negative polarity as the coating layer 2 and the coating layer 41 come into and out of contact with the sheet S. The coating layer 41 is connected to ground via the cleaner 21. At the upstream side of the fixing region Q5, an electric field that reduces adhesion of the negative-polarity toner onto the coating layer 2 is generated between the coating layer 2 from which static electricity is not eliminated and the coating layer 41 from which static electricity is eliminated.

Thus, similar to the configuration according to the first exemplary embodiment in which the electrically-conductive tube 12 is composed of silicone rubber, adhesion of negative-polarity toner onto the coating layer 2 may be reduced in the configuration according to the second exemplary embodiment.

Furthermore, as compared with the configuration according to the first exemplary embodiment in which the electrically-conductive tube 12 is composed of silicone rubber, the releasability of the surface of the coating layer 41 may be improved in the configuration according to the second exemplary embodiment. Therefore, the toner and the like adhered to the surface of the coating layer 41 may be easily removed by the cleaning blades 23 and 31. This may reduce adhesion of toner on the back face of the sheet S during duplex printing, paper particles, floating toner, and so on onto the surface of the pressing roller Fp.

Modifications

Although the exemplary embodiments of the present invention have been described above, the present invention is not to be limited to the above exemplary embodiments and permits various modifications within the technical scope of the invention defined in the claims. Modifications H01 to H014 will be described below.

In each of the above exemplary embodiments, the copier U is described as an example of the image forming apparatus. Alternatively, in a first modification H01, the above exemplary embodiments may be applied to, for example, a facsimile apparatus or a multifunction apparatus having multiple functions. Furthermore, although a so-called color image forming apparatus is described as an example, the above exemplary embodiments may alternatively be applied to a so-called monochrome image forming apparatus. Moreover, the above exemplary embodiments are not limited to a so-called tandem-type image forming apparatus and may be applied to a rotary-type image forming apparatus.

In each of the above exemplary embodiments, the brushes 26 and 27 are described as examples of an antistatic member and a second antistatic member that eliminate static electricity from the pressing roller Fp. Alternatively, in a second modification H02, for example, an arbitrary antistatic member and an arbitrary second antistatic member, such as roller-shaped antistatic members in the related art, may be employed in accordance with the design and specifications.

In each of the above exemplary embodiments, it is desirable that the second brushes 27 be provided at both the front and rear sides of the first brush 26. Alternatively, in a third modification H03, these brushes 27 may be omitted.

In each of the above exemplary embodiments, the cleaning blades 23 and 31 are described as examples of a cleaning member and a second cleaning member that clean the pressing roller Fp. Alternatively, in a fourth modification H04, for example, an arbitrary cleaning member and an arbitrary second cleaning member, such as cleaning brushes, cleaning rollers, or the like in the related art, may be employed in accordance with the design and specifications.

In each of the above exemplary embodiments, it is desirable that the second cleaning blade 31 be provided downstream of the first brush 26 in the rotational direction of the pressing roller Fp. Alternatively, in a fifth modification H05, the second cleaning blade 31 may be omitted, for example, if most of the extraneous matter is removable at the upstream side of the first brush 26 in the rotational direction of the pressing roller Fp by increasing the contact pressure of the cleaning blade 23 or by arranging multiple cleaning blades 23 upstream of the first brush 26, or if adhesion of the floating toner onto the first brush 26 is reduced by disposing the first brush 26 at a position sufficiently distant from the upstream side of the fixing region Q5.

In each of the above exemplary embodiments, the specific materials used as examples for forming the electrically-conductive tube 12 and the coating layer 2 as well as the positive polarity and the negative polarity are appropriately changeable in accordance with, for example, the design and specifications. For example, in each of the above exemplary embodiments, a toner electrostatically charged to negative polarity is used. Alternatively, in a sixth modification H06, a toner electrostatically charged to positive polarity may be used. Moreover, in order to prevent the toner from moving to the heating roller Fh, the electrically-conductive tube of the pressing roller Fp may be composed of an electrically-conductive material that is lower on the electrostatic series than the material used for forming the coating layer of the heating roller Fh.

In each of the above exemplary embodiments, for example, the brushes 26 and 27 are used to eliminate static electricity from the pressing roller Fp. Alternatively, in a seventh modification H07, charging units, such as charging rollers as an example of charging members, may be disposed in place of the brushes 26 and 27 so as to apply voltage with positive polarity to the pressing roller Fp.

In each of the above exemplary embodiments, the pressing roller Fp, which is roller-shaped, is used as an example of a pressing member. Alternatively, in an eighth modification H08, for example, an endless pressing belt may be used in place of the pressing roller Fp, or a pressing member having an arbitrary shape may be used in accordance with the design and specifications.

In each of the above exemplary embodiments, the brushes 26 and 27 and the cleaning blades 23 and 31 are desirably supported by the casing 22 that serves as an example of a frame and that is detachable from the fixing device F. Alternatively, in a ninth modification H09, for example, the casing 22 may be omitted such that the cleaning blades 23 and 31 and the brushes 26 and 27 are fixedly supported by the fixing device F.

In each of the above exemplary embodiments, the cleaning blades 23 and 31 are disposed at both the upstream and downstream sides of the first brush 26 in the rotational direction of the pressing roller Fp. Alternatively, in a tenth modification H010, for example, two or more cleaning blades may be disposed at the upstream side or the downstream side of the first brush 26 or at both the upstream and downstream sides of the first brush 26.

In each of the above exemplary embodiments, the cleaning web 6 as an example of a cleaning member is disposed downstream of the peeling claws 4 in the rotational direction of the heating roller Fh. Alternatively, in an eleventh modification H011, for example, an arbitrary cleaning member, such as a cleaning brush, a cleaning roller, or the like in the related art, may be used in place of the cleaning web 6 in accordance with the design and specifications.

In each of the above exemplary embodiments, it is desirable that the cleaning blades 23 and 31 and the first brush 26 be disposed such that the front and rear ends thereof are not positionally aligned. Alternatively, in a twelfth modification H012, for example, a configuration in which the front and rear ends of an antistatic brush are positionally aligned with the front and rear ends of the cleaning blades 23 and 31, a configuration in which the width of the first brush 26 is made larger than that of the cleaning blade 23, or a configuration in which the first brush 26 and the second brushes 27 are integrated into a single unit is also possible.

In each of the above exemplary embodiments, the cleaning blade 23 and the second cleaning blade 31 have the same width in the front-rear direction. Alternatively, in a thirteenth modification H013, for example, the cleaning blades 23 and 31 may be offset from each other in the width direction of the sheet S while they cover the passing region of the sheet S and the first antistatic region P2*a* such that the front and rear ends of the cleaning blades 23 and 31 are not positionally aligned. As another alternative, the cleaning blade 23 and the second cleaning blade 31 may have different widths in the front-rear direction.

In each of the above exemplary embodiments, the width $L_1$ of the cleaning region P1 in the front-rear direction is set to be smaller than the width $L_S$ of the sheet S. Alternatively, in a fourteenth modification H014, for example, the width $L_1$ of the cleaning region P1 in the front-rear direction may be set to be larger than the width $L_S$ of the sheet S.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that has a heating member that heats a medium, the fixing member rotating while nipping the medium so as to fix an unfixed image onto a surface of the medium;

a pressing member that is disposed facing the fixing member and that applies pressure to the medium in a fixing region between the pressing member and the heating member;

a cleaning member that comes into contact with the pressing member in a cleaning region extending in a direction orthogonal to a medium transport direction so as to clean the pressing member;

an antistatic member that is disposed downstream of the cleaning member in the rotational direction of the pressing member and that comes into contact with a surface of the pressing member in an antistatic region, which overlaps the cleaning region in the direction orthogonal to the medium transport direction, so as to eliminate static electricity from the pressing member; and a second cleaning member that comes into contact with the pressing member so as to clean the pressing member, wherein the fixing region, the cleaning member, the antistatic member, and the second cleaning member are arranged in an order of the fixing region, the cleaning member, the antistatic member, and the second cleaning member in a rotational direction of the pressing member.

2. The fixing device according to claim 1, wherein the antistatic member is provided such that opposite widthwise ends thereof are disposed within opposite widthwise ends of the cleaning region.

3. The fixing device according to claim 1, further comprising:

a second antistatic member that is disposed outside opposite widthwise ends of the cleaning region and that eliminates the static electricity from the pressing member.

4. The fixing device according to claim 1, wherein the heating member has a surface composed of a material electrostatically charged to the same polarity as a developer in electrostatic series, relative to a material that constitutes the surface of the pressing member.

5. The fixing device according to claim 4, wherein the surface of the heating member is composed of a fluoroplastic material.

6. The fixing device according to claim 1, further comprising:

a supporter that supports the cleaning member and the antistatic member and that is supported in a detachable manner relative to the pressing member.

7. An image forming apparatus comprising:

a transfer device that transfers an image from an image bearing member, which bears the image on a surface thereof, onto a medium; and the fixing device according to claim 1 that fixes the image transferred on the medium.

8. The fixing device according to claim 1, wherein the first cleaning member, the second cleaning member and the antistatic member are disposed such that a front and rear end of each thereof are not aligned.

* * * * *